United States Patent [19]

Zinser

[11] 3,996,694

[45] Dec. 14, 1976

[54] PARACHUTE TOY

[75] Inventor: Edward Zinser, E. Meadow, N.Y.

[73] Assignee: Lawrence Peska Associates, Inc., New York, N.Y. ; a part interest

[22] Filed: Feb. 27, 1975

[21] Appl. No.: 553,577

[52] U.S. Cl. ..... 46/86 R; 46/116

[51] Int. Cl.[2] ..... A63H 33/20

[58] Field of Search ..... 272/6; 46/130, 132, 46/116, 86 R, 32; 273/24 E, 95 A

[56] References Cited

UNITED STATES PATENTS

| | | | |
|---|---|---|---|
| 886,505 | 5/1908 | Hizer | 46/86 R |
| 1,441,221 | 1/1923 | Fourcher | 273/26 E |
| 2,153,011 | 4/1939 | Switlik | 272/6 |
| 2,311,171 | 2/1943 | Hawthorne | 272/6 |
| 2,363,970 | 11/1944 | Kolep | 46/86 R |
| 2,606,025 | 8/1952 | Hornig | 273/26 E |
| 2,977,117 | 3/1961 | Taylor | 272/31 A |
| 3,194,557 | 7/1965 | Holley | 273/26 E |
| 3,893,669 | 7/1975 | Myers | 273/26 E |

FOREIGN PATENTS OR APPLICATIONS

| | | | |
|---|---|---|---|
| 999,234 | 10/1951 | France | 46/86 |

*Primary Examiner*—F. Barry Shay

[57] ABSTRACT

A parachute toy includes a stand having affixed perpendicularly thereon an upwardly extending hollow tube member having an open end. An L-shaped hollow tube has a vertical and horizontal portion with an open end, wherein said vertical portion is slidably contained in said tube member. A parachute portion has affixed thereon downwardly extending chord lines, wherein a pair of ring members are affixed to the bottom ends of the chord lines. The rings are adapted to receive the arms of a toy doll. One end of a chord slidably contained in the L-shaped member extends outwardly through said open end of horizontal portion and is affixed onto said parachute portion. The other end of the chord extends outwardly through a hole in the vertical portion, wherein a counterbalance weight assembly cooperates with the other end of the chord.

1 Claim, 3 Drawing Figures

PARACHUTE TOY

SUMMARY OF THE INVENTION

My present invention relates to a unique and novel parachute toy, wherein the toy is adapted to receive a doll that is subjected to a simulated parachute jump.

A number of U.S. Pat. Nos. 2,363,970; 3,205,613; and 3,432,962 have employed various parachute toys, but these aforementioned toys are non-applicable to my present invention.

An object of my present invention is to provide a parachute toy of simple design, capable of vertical height adjustment, capable of controlling the rate of all of the parachute, and capable of receiving many different type dolls.

Briefly, my present invention comprises a stand having affixed perpendicularly thereon an upwardly extending hollow tube member having an open end. An L-shaped hollow tube has a vertical and horizontal portion with an open end, wherein said vertical portion is slidably contained in said tube member. A parachute portion has affixed thereon downwardly extending chord lines, wherein a pair of ring members are affixed to the bottom ends of the chord lines. The rings are adapted to receive the arms of a toy doll. One end of a chord slidably contained in the L-shaped member extends outwardly through said open end of horizontal portion and is affixed onto said parachute portion. The other end of the chord extends outwardly through a hole in the vertical portion, wherein a counterbalance weight assembly cooperates with the other end of the chord.

BRIEF DESCRIPTION OF THE DRAWINGS

The objects and features of the invention may be understood with reference to the following detailed description of an illustrative embodiment of the invention taken together with the accompanying drawings in which.

DESCRIPTION OF THE PREFERRED EMBODIMENT

Figure 1:
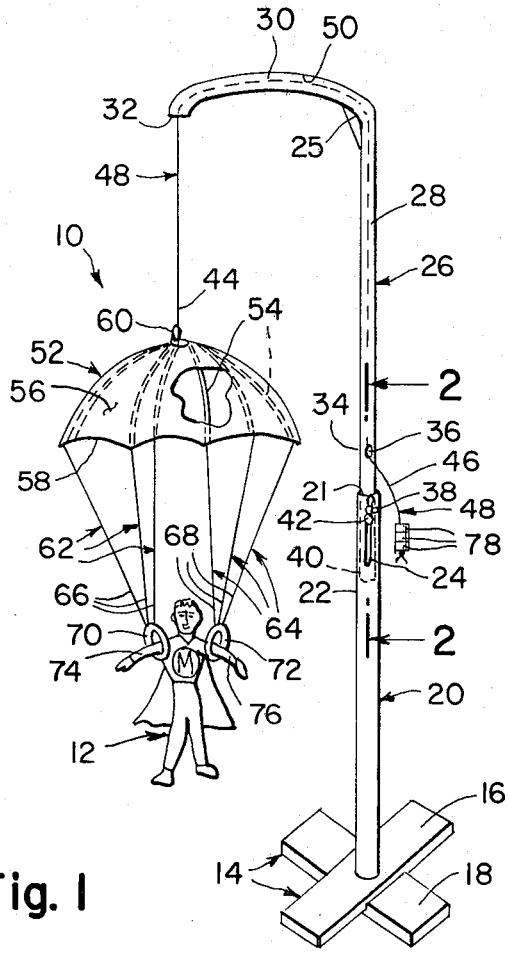
FIG. 1 illustrates a front perspective view of a parachute toy.
Figure 2:
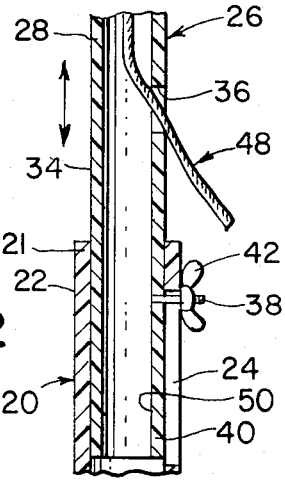
FIG. 2 illustrates a cross-sectional view of a section stand of the parachute toy taken along line 2—2 of FIG. 1.

Turning now descriptively to the drawings in which similar reference characters denote similar elements throughout the several views:

FIG. 1 illustrates a parachute toy 10 adapted to receive a toy doll 12, wherein the doll 12 is subjected to a simulated parachute jump. The parachute toy 10 comprises a stand 14 formed from two crossed elongated members 16, 18, wherein the elongated hollow cylindrical tube member 20 having an open upper end 21 extends perpendicularly upwardly from the stand 14. The upper circumferential periphery 22 of tube member 20 has a longtitudinal slot aperture 24 therethrough. A hollow L-shaped tube 26 has a longer vertical portion 28 and a shorter horizontal portion 30, wherein the outer free open end 32 of portion 30 is curved downwardly. The juncture point 25 of portions 28, 30 is reinforced with a reinforcing element. The lower circumferential periphery 34 of portion 28 has a hole 36 therethrough. A threaded blot member 38 is affixed perpendicularly onto the periphery 34 of portion 28 between hole 36 and the lower end 40 of the portion 28. As shown in FIG. 2, the lower end 40 of portion 28 is slidably contained within the upper end 21 of tube member 20, wherein blot member 38 extends outwardly through aperture 34. A wing nut 42 threadably engages blot member 38 as wing nut 42 abutts the outside circumferential periphery 22 of tube member 20.

Referring back to FIG. 1, the ends 44, 46 of a chord member 48 contained within the bore 50 of tube 26 extend outwardly through the open end 32 and hole 36. A parachute portion 52 consists of a plurality of curved rib members 54 having a canopy 56 affixed thereon, wherein the outer peripheral edge 58 of the canopy 56 can be scalloped. An eyelet 60 is affixed to the top center of the canopy 56 wherein one end 44 of chord member 48 is affixed to the eyelet 60. Two sets of a plurality of chord lines 62, 64 are affixed onto the rib members 54, wherein the chord lines 62, 64 extend downwardly. The lower ends 66, 68 of each set of chord lines 62, 64 are affixed onto ring members 70, 72 adapted to receive the arms 74, 76 of a toy doll 12.

Figure 3:
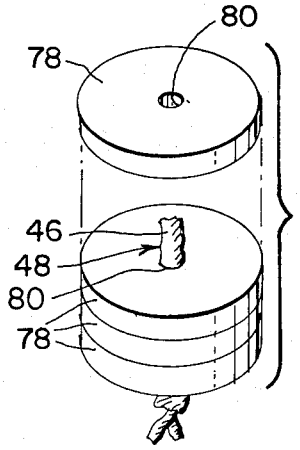
FIG. 3 illustrates a perpective view of a weight assembly of the parachute toy.

As shown in FIGS. 1, 3 a counterbalance weight assembly consists of a plurality of circular disc members 78 each having central holes 80 therethrough, wherein the other end 46 of chord member 48 is contained through holes 80 and knotted on its end.

In use, the user pulls the other end 46 of chord member 48 to pull the parachute portion 52 upper to portion 30. When the other end 46 of chord member 48 is released, the parachute portion 52 moves in a vertical downward direction. The speed of the parachute portion 52 is controlled by the weight of the doll 12 and disc members 78.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A parachute toy, which comprises:

a. a stand formed from two crossed elongated members;

b. a hollow tubular member extending perpendicularly upward from a center of said stand, an upper end of said tubular member having a longitudinally aligned slot aperture therethrough;

c. an L-shaped hollow tube having a shorter horizontal portion, with an open free end and a longer vertical portion, said longer vertical portion slidably contained in said upper end of said tubular member, a lower end of said L-shaped hollow tube having a hole therethrough;

d. a threaded bolt member affixed perpendicularly onto an outside peripheral portion of said L-shaped hollow tube between said hole and said lower end of said L-shaped hollow tube, said bolt member extending outwardly through said aperture of said tubular member;

e. a nut threadably engaging said bolt member and said nut abutting said outside periphery of said tubular member;

f. a cord member slidably contained with a bore of said L-shaped hollow tube, one end of said cord extending outwardly from said free end of said horizontal portion of said L-shaped hollow tube and another end of said cord extending outwardly through said hole of said L-shaped hollow tube;

g. a parachute portion having a plurality of curved rib members having a canopy affixed thereon;

h. an eyelet affixed to a top center of said canopy, said one end of said cord secured to said eyelet;

i. two sets of a plurality of cord lines affixed to said parachute portion;

j. a ring member affixed onto the lower ends of each said set of cord lines, each ring member adapted to receive one of the arms of a doll; and k. a counter balance weight assembly affixed to said other end of said cord, said counter balance weight assembly formed from a plurality of circularly shaped disc members, each said disc member having a central hole therèthrough, said other end of said cord extending through said central holes of said disc members, and said other end of said cord being knotted.

* * * * *